US012239892B2

(12) United States Patent
Chauvin et al.

(10) Patent No.: US 12,239,892 B2
(45) **Date of Patent: *Mar. 4, 2025**

(54) BALL BATS WITH REDUCED DURABILITY REGIONS FOR DETERRING ALTERATION

(71) Applicant: EASTON DIAMOND SPORTS, LLC, Thousand Oaks, CA (US)

(72) Inventors: Dewey Chauvin, Simi Valley, CA (US); Ian Montgomery, Simi Valley, CA (US); Frederic St-Laurent, Oak Park, CA (US)

(73) Assignee: EASTON DIAMOND SPORTS, LLC, Thousand Oaks, CA (US)

( * ) Notice: Subject to any disclaimer, the term of this patent is extended or adjusted under 35 U.S.C. 154(b) by 689 days.

This patent is subject to a terminal disclaimer.

(21) Appl. No.: 17/453,412

(22) Filed: Nov. 3, 2021

(65) Prior Publication Data

US 2022/0054909 A1 Feb. 24, 2022

Related U.S. Application Data

(63) Continuation of application No. 15/654,513, filed on Jul. 19, 2017, now Pat. No. 11,167,190.

(51) Int. Cl.
*A63B 59/50* (2015.01)
*A63B 59/51* (2015.01)
(Continued)

(52) U.S. Cl.
CPC ..... *A63B 59/50* (2015.10); *A63B 59/51* (2015.10); *A63B 59/54* (2015.10);
(Continued)

(58) Field of Classification Search
CPC ..... A63B 59/50; A63B 59/51; A63B 59/52; A63B 59/54; A63B 2120/18; A63B 2209/02; A63B 2209/023
(Continued)

(56) References Cited

U.S. PATENT DOCUMENTS 1,611,858 A 12/1926 Middlekauff
4,014,542 A 3/1977 Tanikawa
(Continued)

FOREIGN PATENT DOCUMENTS

CA 2577184 C 4/2014
CN 1067388 A 12/1992
(Continued)

OTHER PUBLICATIONS

ASTM International, F2219—14 Standard Test Methods for Measuring High-Speed Bat Performance, USA Baseball ABI Protocol, May 2016.

(Continued)

*Primary Examiner* — Joseph B Baldori
(74) *Attorney, Agent, or Firm* — Perkins Coie LLP

(57) ABSTRACT

Representative embodiments of the present technology may include a ball bat with a handle, a barrel attached to or continuous with the handle along a longitudinal axis of the bat, and a reduced-durability region positioned in the barrel. The reduced-durability region may include two adjacent stacks of composite laminate plies, wherein the stacks are spaced apart from each other along the longitudinal axis to form a first gap therebetween. A separation ply may be positioned in the first gap between the stacks. The separation ply may include a non-woven mat material. At least one cap ply element may be positioned around an end of one of the stacks. In some embodiments, an axis of the first gap is oriented at an oblique angle relative to the longitudinal axis of the bat.

19 Claims, 3 Drawing Sheets

(51) Int. Cl.
*A63B 59/54* (2015.01)
*A63B 102/18* (2015.01)

(52) U.S. Cl.
CPC ..... *A63B 2102/18* (2015.10); *A63B 2209/02* (2013.01); *A63B 2209/14* (2013.01)

(58) Field of Classification Search
USPC ..... 473/564, 566, 567
See application file for complete search history.

(56) References Cited

U.S. PATENT DOCUMENTS 4,025,377 A 5/1977 Tanikawa
4,132,130 A 1/1979 Fletcher et al.
4,150,291 A 4/1979 Gulley
4,505,479 A 3/1985 Souders
4,604,319 A 8/1986 Evans et al.
4,780,346 A 10/1988 Denoel
4,804,315 A 2/1989 Ferris et al.
4,818,584 A 4/1989 Eisenmann
4,848,745 A 7/1989 Bohannan et al.
4,867,399 A 9/1989 Therond
4,931,247 A 6/1990 Yeh
4,963,408 A 10/1990 Huegli
5,048,441 A 9/1991 Quigley
5,057,353 A 10/1991 Maranci et al.
5,131,651 A 7/1992 You
5,301,940 A 4/1994 Seki et al.
5,303,917 A 4/1994 Uke
5,362,046 A 11/1994 Sims
5,364,095 A 11/1994 Easton et al.
5,380,003 A 1/1995 Lanctot
5,395,108 A 3/1995 Sounders et al.
5,415,398 A 5/1995 Eggiman
RE35,081 E 11/1995 Quigley
5,490,669 A 2/1996 Smart
5,511,777 A 4/1996 McNeely
5,516,097 A 5/1996 Huddleston
5,556,695 A 7/1996 Mazelsky
5,593,158 A 1/1997 Filice et al.
5,624,115 A 4/1997 Baum
5,641,366 A 6/1997 Hohman
5,676,610 A 10/1997 Bhatt et al.
5,711,728 A 1/1998 Marcelo
5,759,113 A 6/1998 Lai et al.
5,772,541 A 6/1998 Buiatti
5,833,561 A 11/1998 Kennedy et al.
5,899,823 A 5/1999 Eggiman
5,964,673 A 10/1999 MacKay, Jr.
6,007,439 A 12/1999 MacKay
6,010,417 A 1/2000 Young et al.
6,033,758 A 3/2000 Kocher et al.
6,042,493 A 3/2000 Chauvin et al.
6,053,828 A 4/2000 Pitsenberger
6,265,333 B1 7/2001 Dzenis et al.
6,287,222 B1 9/2001 Pitsenberger
6,301,821 B1 * 10/2001 Suzue ..... A01K 87/00 43/18.5
6,344,007 B1 2/2002 Feeney et al.
6,352,485 B1 3/2002 Philpot et al.
6,383,101 B2 5/2002 Eggiman et al.
6,398,675 B1 6/2002 Eggiman et al.
6,425,836 B1 7/2002 Misono et al.
6,440,017 B1 8/2002 Anderson
6,461,260 B1 10/2002 Higginbotham
6,497,631 B1 12/2002 Fritzke et al.
6,508,731 B1 1/2003 Feeney et al.
6,634,969 B2 10/2003 Forsythe et al.
6,663,517 B2 12/2003 Chauvin et al.
6,723,012 B1 4/2004 Sutherland
6,723,127 B2 4/2004 Ralph et al.
6,729,983 B1 5/2004 Vakili et al.
6,755,757 B2 6/2004 Sutherland
6,761,653 B1 7/2004 Higginbotham et al.
6,764,419 B1 7/2004 Giannetti et al.
6,776,735 B1 8/2004 Belanger et al.
6,808,464 B1 10/2004 Nguyen
6,863,628 B1 3/2005 Brandt
6,866,598 B2 3/2005 Gianetti et al.
6,872,156 B2 3/2005 Ogawa et al.
6,997,826 B2 2/2006 Sutherland
7,006,947 B2 2/2006 Tryon, III et al.
7,087,296 B2 8/2006 Porter
7,115,054 B2 10/2006 Giannetti
7,163,475 B2 1/2007 Gianetti
7,344,461 B2 3/2008 Nguyen
7,431,655 B2 10/2008 McCarty et al.
7,442,134 B2 10/2008 Giannetti et al.
7,585,235 B2 9/2009 Misono et al.
7,699,725 B2 4/2010 McNamee et al.
7,749,115 B1 7/2010 Cruz
7,857,719 B2 12/2010 Gianetti et al.
7,867,114 B2 1/2011 Sutherland
7,874,946 B2 1/2011 Smith
7,914,404 B2 3/2011 Gianetti et al.
7,980,970 B2 7/2011 Watari
7,985,149 B2 7/2011 Watari
8,029,391 B2 10/2011 McNamee et al.
8,182,377 B2 5/2012 Chuang et al.
8,197,366 B2 6/2012 Chauvin
8,282,516 B2 10/2012 Chauvin et al.
8,376,881 B2 2/2013 Chuang et al.
8,409,038 B2 4/2013 MacDougall
8,512,174 B2 8/2013 Epling et al.
8,602,924 B2 12/2013 Kazuhiko et al.
8,708,845 B2 4/2014 Chuang et al.
8,814,733 B2 8/2014 Tsukamoto
8,979,682 B2 3/2015 Chuang et al.
9,067,109 B2 6/2015 Epling et al.
9,149,697 B2 10/2015 Epling et al.
9,211,460 B2 12/2015 Slater et al.
9,238,163 B2 1/2016 Slater et al.
9,242,155 B1 * 1/2016 Lindsay ..... A63B 60/42
9,427,640 B2 8/2016 Davis et al.
9,744,416 B2 8/2017 Chuang et al.
10,159,878 B2 * 12/2018 Fitzgerald ..... B29C 70/48
2001/0014634 A1 8/2001 MacKay, III
2002/0016230 A1 2/2002 Okuyama et al.
2002/0091022 A1 7/2002 Fritzke et al.
2002/0098924 A1 7/2002 Houser et al.
2002/0151392 A1 10/2002 Buiatti et al.
2002/0198071 A1 12/2002 Snow
2003/0153416 A1 8/2003 Anderson
2003/0186763 A1 10/2003 Eggiman et al.
2003/0195066 A1 10/2003 Eggiman et al.
2004/0077439 A1 4/2004 Eggiman et al.
2004/0132563 A1 7/2004 Gianetti et al.
2004/0132564 A1 7/2004 Gianetti
2004/0176197 A1 9/2004 Sutherland
2004/0209716 A1 10/2004 Vacek et al.
2005/0070384 A1 3/2005 Fitzgerald et al.
2005/0070387 A1 3/2005 Fitzgerald
2005/0143203 A1 6/2005 Sounders et al.
2005/0202909 A1 * 9/2005 Giannetti ..... A63B 59/50 473/567
2005/0227795 A1 10/2005 Fritzke
2006/0025251 A1 2/2006 Giannetti et al.
2006/0025253 A1 * 2/2006 Giannetti ..... A63B 60/00 473/567
2006/0247078 A1 11/2006 Gianetti et al.
2006/0247079 A1 11/2006 Sutherland et al.
2007/0202974 A1 8/2007 Gianetti
2007/0205201 A1 9/2007 Cundiff et al.
2007/0219027 A1 9/2007 Chong
2007/0254752 A1 * 11/2007 Sutherland ..... A63B 59/50 473/564
2008/0039241 A1 2/2008 Pope et al.
2008/0070726 A1 3/2008 Watari et al.
2009/0065299 A1 3/2009 Vito et al.
2009/0085299 A1 3/2009 Shibayama
2009/0130425 A1 5/2009 Whitaker
2009/0181813 A1 7/2009 Gianetti et al.
2009/0215560 A1 8/2009 McNamee et al.
2009/0280935 A1 11/2009 Watari et al.

(56) References Cited

U.S. PATENT DOCUMENTS

| | | | | |
|---|---|---|---|---|
| 2010/0160095 | A1 | 6/2010 | Chauvin et al. | |
| 2011/0165976 | A1 | 7/2011 | Chuang et al. | |
| 2011/0195808 | A1 | 8/2011 | Chauvin et al. | |
| 2011/0287875 | A1 | 11/2011 | Vander Pol et al. | |
| 2012/0142461 | A1 | 6/2012 | Chuang et al. | |
| 2013/0116070 | A1 | 5/2013 | Xun | |
| 2013/0165279 | A1 | 6/2013 | Chuang et al. | |
| 2013/0184108 | A1 | 7/2013 | Epling | |
| 2013/0316859 | A1 | 11/2013 | Burger et al. | |
| 2014/0080642 | A1 | 3/2014 | Epling | |
| 2014/0213395 | A1 | 7/2014 | Chuang et al. | |
| 2015/0018139 | A1 | 1/2015 | Slater et al. | |
| 2016/0158617 | A1* | 6/2016 | Carlson | A63B 69/0002 473/566 |
| 2017/0056736 | A1 | 3/2017 | Fitzgerald et al. | |
| 2017/0252617 | A1 | 9/2017 | Caron Kardos | |
| 2018/0174495 | A1 | 6/2018 | Chauvin et al. | |
| 2019/0022483 | A1 | 1/2019 | Chauvin | |
| 2019/0022484 | A1 | 1/2019 | Chauvin et al. | |
| 2019/0054356 | A1* | 2/2019 | Epling | A63B 59/56 |
| 2019/0054357 | A1 | 2/2019 | Epling et al. | |
| 2019/0381377 | A1 | 12/2019 | Chauvin et al. | |
| 2021/0252358 | A1* | 8/2021 | Chauvin | A63B 59/54 |

FOREIGN PATENT DOCUMENTS

| | | | |
|---|---|---|---|
| CN | 2684892 | | 3/2005 |
| EP | 0585965 | A1 | 3/1994 |
| WO | 2004062734 | A2 | 7/2004 |
| WO | 2006015160 | A1 | 2/2006 |
| WO | 2011084847 | A1 | 7/2011 |
| WO | 2013101465 | A1 | 7/2013 |

OTHER PUBLICATIONS

Canadian Intellectual Property Office, "Examiner's Report" for Application No. 2,852,513, Oct. 19, 2018, 10 pages.
Canadian Intellectual Property, Office, "Search Report and Written Opinion", for PCT/CA2016/051007, Nov. 3, 2016, 8 pgs.
Fibre Reinforced Plastic, "Sandwich Composite and Core Material Web Page", available at http://www.fibre-reinforced-plastic.com/2010/12/sandwich-composite-and-core-material.html, dated Dec. 12, 2010, website visited Jun. 18, 2018.
Global Plastic Sheeting, "GPS Diamond Scrim", available at https://www.globalplasticsheeting.com/gps-diamond-scrim-30-36-45-lldpe, exact publication date unknown, website visited Dec. 27, 2017.
Global Plastic Sheeting, "Poly Scrim Crawl Space Vapor Barriers", available at https://www.globalplasticsheeting.com/ultra-scrim-crawl-space-vapor-barriers, exact publication date unknown, website visited Dec. 27, 2017.
IP Australia, "Patent Examination Report No. 1", for AU2012362912, Nov. 18, 2016.
Japanese Patent Office, "Office Action", for JP2014-550320, with English translation Oct. 25, 2016.
Mustone et al., "Using LS-DYNA to Develop a Baseball Bat Performance and Design Tool", 6th International LS-DYNA Users Conference, Apr. 9-10, 2000, Detroit, MI.
State Intellectual Property Office, China PRC, "First Office Action", for CN201280064601.8 with English Translation, Aug. 18, 2015.
Taiwan Intellectual Property Office, Official Letter and Search Report for TW101148678, with English Translation, Jul. 12, 2016.
USPTO, "International Search Report and Written Opinion" for PCT/US05/026872, Dec. 5, 2005.
U.S. Appl. No. 14/244,566, "Final Office Action", Nov. 23, 2016.
U.S. Appl. No. 14/244,566, "Final Office Action", Dec. 14, 2015.
U.S. Appl. No. 14/244,566, "Non-Final Office Action", May 31, 2016.
U.S. Appl. No. 14/244,566, "Non-Final Office Action", Jun. 18, 2015.
U.S. Appl. No. 15/385,268, "Non-Final Office Action", Jun. 29, 2018.
U.S. Appl. No. 15/385,268, Final Office Action, Feb. 1, 2019.
U.S. Appl. No. 15/385,268, Non-Final Office Action, Jul. 5, 2019.
U.S. Appl. No. 16/012,085, Final Office Action, Sep. 27, 2019.
U.S. Appl. No. 16/012,085, Non-Final Office Action, Apr. 2, 2019.
U.S. Appl. No. 16/132,199, Final Office Action, Sep. 26, 2019.
U.S. Appl. No. 16/132,199, Non-Final Office Action, Mar. 29, 2019.
USPTO, Search Report and Written Opinion for PCT/US10/62083, mailed Apr. 6, 2011.
USPTO, Search Report and Written Opinion for PCT/US12/69268, mailed Apr. 15, 2013.

* cited by examiner

BALL BATS WITH REDUCED DURABILITY REGIONS FOR DETERRING ALTERATION

CROSS-REFERENCE TO RELATED APPLICATION

This application is a continuation of U.S. patent application Ser. No. 15/654,513, filed Jul. 19, 2017, which is incorporated herein by reference in its entirety.

BACKGROUND

Baseball and softball governing bodies have imposed various bat performance limits over the years with the goal of regulating batted ball speeds. Each association generally independently develops various standards and methods to achieve a desired level of play.

During repeated use of bats made from composite materials, the matrix or resin of the composite material tends to crack and the fibers tend to stretch or break. Sometimes the composite material develops interlaminar failures, which involve plies or layers of composite materials in a composite bat separating or delaminating from each other along a failure plane between the layers. This break-in tends to reduce stiffness and increase the elasticity or trampoline effect of a bat against a ball, which tends to temporarily increase bat performance.

As a bat breaks in, and before it fully fails (for example, before the bat wall experiences a through-thickness failure), it may exceed performance limitations specified by a governing body, such as limitations related to batted ball speed. Some such limitations are specifically aimed at regulating the performance of a bat that has been broken in from normal use (such as BBCOR, or "Bat-Ball Coefficient of Restitution").

Some unscrupulous players choose to intentionally break in composite bats to increase performance. Intentional break-in processes may be referred to as accelerated break-in (ABI) and may include techniques such as "rolling" a bat or otherwise compressing it, or generating hard hits to the bat with an object other than a ball. Such processes tend to be more abusive than break-in during normal use. A rolled or otherwise intentionally broken-in bat may temporarily exceed limitations established by a governing body. Accordingly, unscrupulous users may be able to perform an ABI procedure to increase performance without causing catastrophic failure of the bat that would render it useless.

SUMMARY

Representative embodiments of the present technology include a ball bat with a handle, a barrel attached to or continuous with the handle along a longitudinal axis of the bat, and a reduced-durability region positioned in the barrel. The reduced-durability region may include two adjacent stacks of composite laminate plies, wherein the stacks are spaced apart from each other along the longitudinal axis to form a first gap therebetween. A separation ply may be positioned in the first gap between the stacks. In some embodiments, the separation ply may include a composite fiber mat. In some embodiments, the separation ply may include a release ply. In some embodiments, the separation ply includes a non-woven fiber mat material. At least one cap ply element may be positioned around an end of one of the stacks. In some embodiments, an axis of the first gap is oriented at an oblique angle relative to the longitudinal axis of the bat. In some embodiments, at least one of the stacks includes one or more fibrous bundles, the one or more fibrous bundles being oriented transverse to the at least one of the stacks and extending at least partially circumferentially about the barrel.

The barrel may further include an outwardly facing skin facing away from the barrel and an inwardly facing skin facing an interior hollow region of the barrel. At least one of the outwardly facing skin or the inwardly facing skin may include a discontinuity forming a second gap in the at least one of the outwardly facing skin or the inwardly facing skin along the longitudinal axis, the first gap and the second gap being connected to each other. A cover layer may be positioned over the second gap. The cover layer may include carbon fiber composite.

Other features and advantages will appear hereinafter. The features described above can be used separately or together, or in various combinations of one or more of them.

BRIEF DESCRIPTION OF THE DRAWINGS

In the drawings, wherein the same reference number indicates the same element throughout the views.

DETAILED DESCRIPTION

The present technology is directed to ball bats with reduced-durability regions for deterring alteration, and associated systems and methods. Various embodiments of the technology will now be described. The following description provides specific details for a thorough understanding and enabling description of these embodiments. One skilled in the art will understand, however, that the invention may be practiced without many of these details. Additionally, some well-known structures or functions, such as structures or functions common to ball bats and composite materials, may not be shown or described in detail so as to avoid unnecessarily obscuring the relevant description of the various embodiments. Accordingly, embodiments of the present technology may include additional elements or exclude some of the elements described below with reference to FIGS. 1-7, which illustrate examples of the technology.

The terminology used in the description presented below is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this detailed description section.

Where the context permits, singular or plural terms may also include the plural or singular term, respectively. Moreover, unless the word "or" is expressly limited to mean only a single item exclusive from the other items in a list of two or more items, then the use of "or" in such a list is to be interpreted as including (a) any single item in the list, (b) all of the items in the list, or (c) any combination of items in the list. Further, unless otherwise specified, terms such as "attached" or "connected" are intended to include integral connections, as well as connections between physically separate components.

Specific details of several embodiments of the present technology are described herein with reference to baseball or softball. The technology may also be used in other sporting good implements or in other sports or industries in which it may be desirable to discourage tampering, damage, or overuse in composites or other structures. Conventional aspects of ball bats and composite materials may be described in reduced detail herein for efficiency and to avoid obscuring the present disclosure of the technology. In various embodiments, a number of different composite materials suitable for use in ball bats may be used, including, for example, composites formed from carbon fiber, fiberglass, aramid fibers, or other composite materials or combinations of matrices, resins, fibers, laminates, and meshes forming composite materials.

Figure 1:
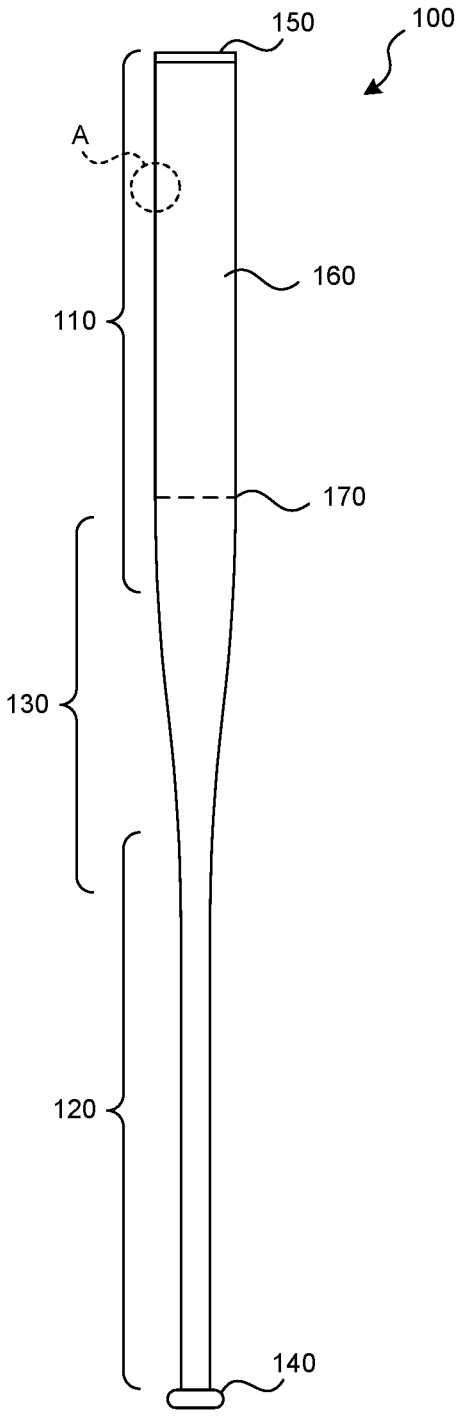
FIG. 1 illustrates a ball bat according to an embodiment of the present technology.

Turning now to the drawings, FIG. 1 illustrates a ball bat 100 having a barrel portion 110 and a handle portion 120. There may be a transitional or taper portion 130 in which a larger diameter of the barrel portion 110 transitions to a narrower diameter of the handle portion 120. The handle portion 120 may include an end knob 140 and the barrel portion 110 may optionally be closed with an end cap 150. The barrel portion 110 may include a non-tapered or straight section 160 extending between the end cap 150 and an end location 170.

The bat 100 may have any suitable dimensions. For example, the bat 100 may have an overall length of 20 to 40 inches, or 26 to 34 inches. The overall barrel diameter may be 2.0 to 3.0 inches, or 2.25 to 2.75 inches. Typical ball bats have diameters of 2.25, 2.625, or 2.75 inches. Bats having various combinations of these overall lengths and barrel diameters, or any other suitable dimensions, are contemplated herein. The specific preferred combination of bat dimensions is generally dictated by the user of the bat 100, and may vary greatly among users.

The barrel portion 110 may be constructed with one or more composite materials. Some examples of suitable composite materials include plies reinforced with fibers of carbon, glass, graphite, boron, aramid (such as Kevlar®), ceramic, or silica (such as Astroquartz®). The handle portion 120 may be constructed from the same materials as, or different materials than, the barrel portion 110. In a two-piece ball bat, for example, the handle portion 120 may be constructed from a composite material (the same or a different material than that used to construct the barrel portion 110), a metal material, or any other material suitable for use in a striking implement such as the bat 100.

FIGS. 2-7 illustrate partial cross-sectional views of a portion of the straight section 160 of the bat barrel 110 according to embodiments of the present technology. Each of FIGS. 2-7 illustrates a two-dimensional projection of a cross-section of a wall of the barrel between an interior portion of the bat and the exterior of the bat. For example, FIGS. 2-7 may illustrate a part of the bat 100 in section A indicated in FIG. 1, or they may illustrate other sections.

Figure 2:
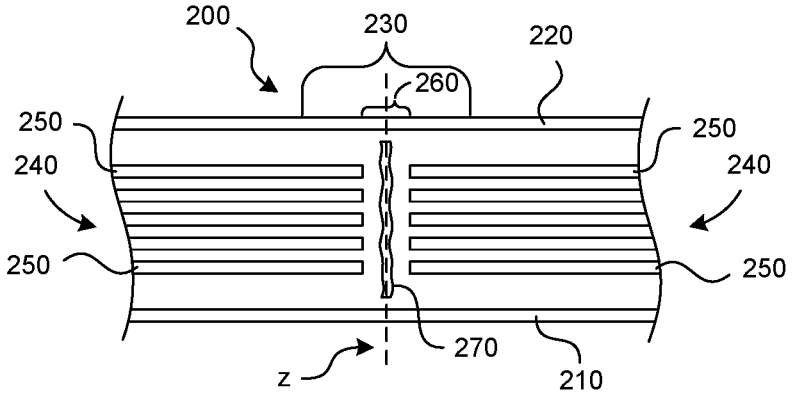
FIG. 2 illustrates a partial cross-sectional view of a portion of a barrel wall having a reduced-durability region according to an embodiment of the present technology.

FIG. 2 illustrates a partial cross-sectional view of a portion of a composite barrel wall 200 in the straight section 160 of the bat 100 according to an embodiment of the present technology. The wall 200 defines an outer structure of the bat 100, which may be hollow in some embodiments. The wall 200 may have an inwardly facing skin 210 positioned to face toward an interior area of the bat 100, and an outwardly facing skin 220 positioned to face outwardly from the bat 100. In some embodiments, the bat 100 may include interior structural elements within the composite wall 200 or elsewhere in the bat 100. The composite barrel wall 200 may be formed from a variety of materials such as the composite materials described herein. For example, the inwardly facing skin 210 or the outwardly facing skin 220 may be formed with a composite material including carbon fibers oriented at approximately 60 degrees relative to the longitudinal axis of the bat 100. Any other suitable fibrous materials and fiber angles may be used.

A reduced-durability region 230 may include two or more stacks 240 of plies 250 of laminate materials positioned on each side of a discontinuity or gap region 260 inside the wall 200. Although the gap region 260 is described as being located between two or more stacks 240, the gap region 260 may also be considered a discontinuity in what would otherwise be a continuous single stack 240 of plies 250. Although five plies 250 are illustrated in each stack 240, any suitable number of plies 250 may form each stack 240, and the stacks 240 may have different quantities of plies 250 from each other. In various embodiments, the plies 250 forming the stacks 240 may be formed from any material or materials suitable for use in ball bats, striking implements, or other equipment, including, for example, carbon fiber in a matrix, glass fiber in a matrix, aramid fibers in a matrix, or other composite materials or combinations of matrices, resins, fibers, or meshes forming composite laminate layers, including other composite materials described herein. The plies 250, the outwardly facing skin 220, and the inwardly facing skin 210 may be formed from pre-impregnated material cured in a mold. In some embodiments, resin transfer molding processes may be used to form the various layers of embodiments of the technology.

In a conventional bat that does not include a gap region 260 (in other words, in a bat with a continuous stack of plies), stresses in the bat wall would generally be distributed along the length of the plies (generally along a longitudinal axis of the bat). In such a conventional bat, forces from impact or other stresses would generally cause the plies to delaminate from each other. The gap region 260 focuses or directs the stress concentration between the stacks 240, thereby creating a new failure plane in addition to existing failure modes, such as delamination. For example, when a bat is rolled or otherwise tampered with, or when a bat has been overly broken in or overused, the wall 200 may break through and along the gap region 260, such as along the Z-axis (labeled "z") of the bat wall 200 or otherwise along a path between the inwardly facing skin 210 and the outwardly facing skin 220. Such a break may cause the wall 200 to fail (destroying the bat) before significant delamination occurs that would otherwise improve performance (including performance that may violate league or organization rules or is otherwise undesirable).

In some bats with gaps or discontinuities between stacks of plies, the gap may be too strong or too narrow to reliably provide such a break after overuse or abuse. In other words, in some bats with gap regions that are too strong, delamination may occur to a significant (or undesirable) degree before a break in the gap region causes total failure of the wall. For example, during the molding process for a composite bat with a gap (such as the gap region 260), plies (such as the plies 250) may move, narrowing or even closing the gap, which may delay or disrupt the failure along the gap. According to embodiments of the present technology, to prevent such movement and to lower the energy needed to trigger the thickness failure along the gap region 260 to a level at which the thickness failure occurs before the plies 250 in the stacks 240 delaminate, a separation ply 270 may be positioned in the gap region 260.

The separation ply 270 also reduces or prevents interweaving, nesting, or bonding of the stacks 240 across the gap region 260, thereby resisting or preventing an undesirable increase in strength at the gap region 260 relative to a gap without such a separation ply 270. For example, if the separation ply 270 allows some bonding between the stacks 240, the gap region 260 may be stronger. If the separation ply 270 is a barrier, it may allow only minimal bonding or no bonding at all across the gap region 260, resulting in a weaker gap region 260. By managing the strength of the wall 200 at the gap region 260, the level of energy at which failure of the wall 200 occurs at the gap region 260 can be tailored to be lower than the energy required to delaminate the stacks 240 in a particular bat configuration.

The separation ply 270 may be formed from any suitable material, depending on the level of bonding desired between the stacks 240. For example, in a heavier bat or in a bat with a relatively high moment of inertia (for example, near or above 6000 ounce-square inch), in which a strong gap region 260 is desired, a strong material may be used, such as one or more carbon fiber or glass fiber composite mats or other fiber composite mats. In some embodiments, the separation ply 270 may be rigid or semi-rigid, while in other embodiments it may be flexible. In a lighter bat or in a bat with a relatively low moment of inertia (for example, near or below 6000 ounce-square inch), in which a gap region 260 may not need to be as strong, a release ply material, such as polytetrafluoroethylene (PTFE, commercially available as TEFLON), nylon sheet, or other release plies may be used. In some embodiments, the release ply material may be perforated or porous, which may increase the strength of the gap region 260 by allowing limited bonding between the stacks 240.

In a particular representative embodiment, the separation ply 270 may be formed from a non-woven mat material having a fiber aerial weight of approximately 30 grams per square meter. Such a material may include a variety of types of fibers and treatments and may function as an inexpensive and reliable material for providing a desired strength in the gap region 260.

The reduced-durability region 230 (centered around the middle of the gap region 260) may be located along the straight section 160 of the bat barrel 110 (see FIG. 1). For example, with reference to FIG. 1, in some embodiments, the reduced-durability region 230 may be located within section A, or it may be located anywhere between approximately one inch from the distal end of the bat 100 having end cap 150 and approximately one inch from the end location 170 of the straight section 160. In other embodiments, the reduced-durability region 230 may be located in other portions of the bat 100. In general, the reduced-durability region 230 may be positioned anywhere a bat may be rolled or tampered with by a user, or anywhere a regulatory body wishes to test the bat 100. In some embodiments, the reduced-durability region 230 may be positioned at or near the center of percussion of the bat 100, as measured by the ASTM F2398-11 Standard. In some embodiments, the reduced-durability region 230 may be positioned somewhere between the center of percussion and the end location 170 of the straight section 160.

Figure 3:
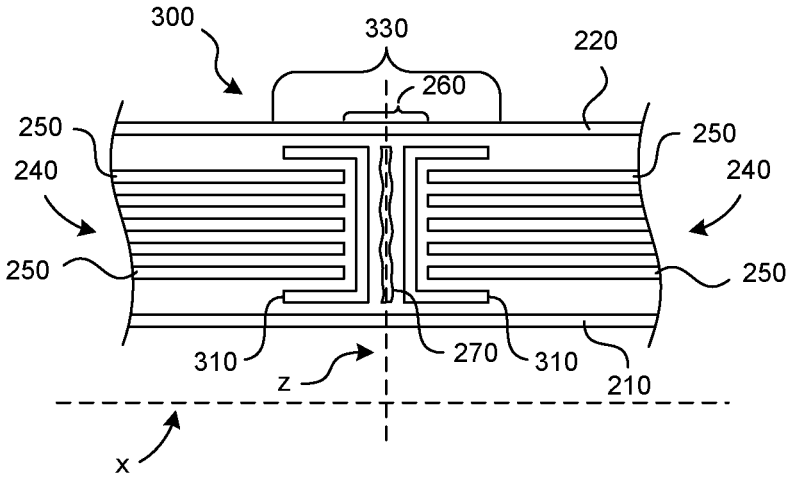
FIG. 3 illustrates a partial cross-sectional view of a portion of a barrel wall having a reduced-durability region according to another embodiment of the present technology.

FIG. 3 illustrates a partial cross-sectional view of a portion of a composite barrel wall 300 in the straight section 160 of the bat 100 having a reduced-durability region 330 according to another embodiment of the present technology. The wall 300 illustrated in FIG. 3 may be generally similar to the wall 200 illustrated and described above with regard to FIG. 2, but it may further include one or more cap ply elements 310, which are described in additional detail below. For example, the barrel wall 300 may include an inwardly facing skin 210, an outwardly facing skin 220, stacks 240 of plies 250 on either side of a gap region 260, and a separation ply 270 to reduce or prevent bonding across the gap region 260.

When a crack forms in the gap region 260, the cap ply elements 310 prevent (or at least resist) proliferation of the crack to the stacks 240 of plies 250. In other words, the cap ply elements 310 prevent or resist delamination of the stacks 240 of plies 250 by preventing or resisting spreading of the crack along the axial length of the bat (i.e., along the longitudinal or x-axis of the bat, marked with "x" in FIG. 3). Thus, when a crack forms it will be generally directed along the z-axis through the gap region 260 or otherwise along the gap region 260 between the inwardly facing skin 210 and the outwardly facing skin 220, as described above.

The cap ply elements 310 may be formed from a foam material, a plastic material, or another material suitable for being folded, molded, or otherwise shaped around an edge of each of the stacks 240. In some embodiments, the cap ply elements 310 may be formed from similar materials as the separation ply 260. In some embodiments, the cap ply elements 310 may be rigid. In other embodiments, the cap ply elements 310 may be flexible (for example, they may be formed with an elastomer material to make the cap ply elements 310 resilient). Because FIG. 3 illustrates a cross-section, it is understood that each cap ply element 310 may be in the form of a ring positioned along the circumference of an assembled bat.

Figure 4:
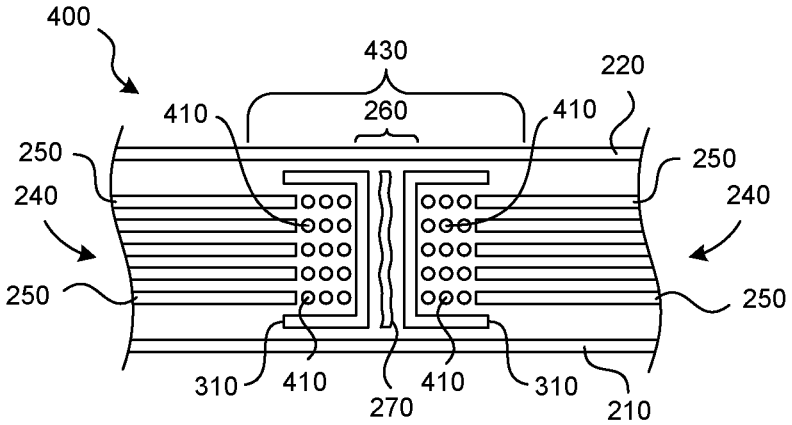
FIG. 4 illustrates a partial cross-sectional view of a portion of a barrel wall having a reduced-durability region according to another embodiment of the present technology.

FIG. 4 illustrates a partial cross-sectional view of a portion of a composite barrel wall 400 in the straight section 160 of the bat 100 having a reduced-durability region 430 according to another embodiment of the present technology. The wall 400 illustrated in FIG. 4 may be generally similar to the wall 300 illustrated and described above with regard to FIG. 3. In addition, the stacks 240 of plies 250 may also include one or more circumferential fibers or fibrous bundles 410 positioned at the end of the stacks 240 between the stacks 240 and the cap ply elements 310. The fibrous bundles 410 may be oriented to be generally transverse (such as perpendicular) to the plies 250, for example, they may be positioned circumferentially through the interior of the barrel wall 400 around at least a portion of the bat. The fibrous bundles 410 increase local stiffness in the vicinity of the gap region 260 to help guide the failure of the wall 400 through the gap region 260. Although the fibrous bundles 410 are illustrated as being adjacent to the cap ply elements 310 in FIG. 4, in some embodiments, they may be positioned in other locations.

Figure 5:
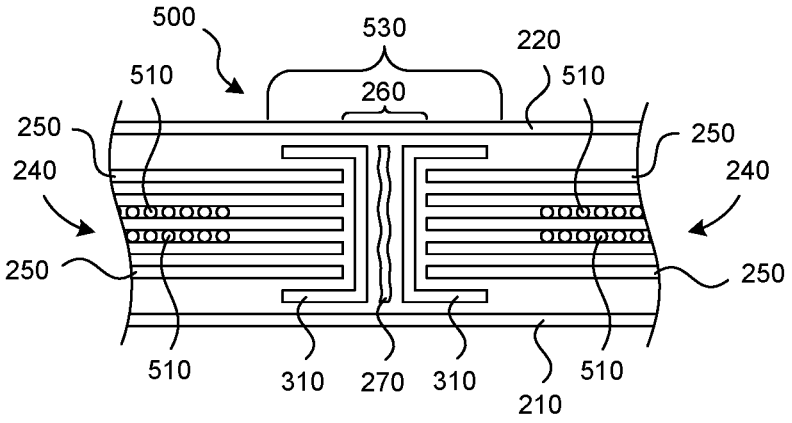
FIG. 5 illustrates a partial cross-sectional view of a portion of a barrel wall having a reduced-durability region according to another embodiment of the present technology.

For example, FIG. 5 illustrates a partial cross-sectional view of a portion of a composite barrel wall 500 in the straight section 160 of the bat 100 having a reduced-durability region 530 according to another embodiment of the present technology. The wall 500 illustrated in FIG. 5 may be generally similar to the wall 300 illustrated and described above with regard to FIG. 3. In addition, the stacks 240 of plies 250 may also include one or more circumferential fibers 510 positioned between plies 250 in the stacks 240. For example, there may be a plurality of circumferential fibers or fibrous bundles 510 sandwiched between two or more plies 250. The fibrous bundles 510 may be oriented transverse (such as perpendicular) to the plies 250, for example, they may be positioned circumferentially through the interior of the wall 500 around at least a portion of the bat. The fibrous bundles 510 increase local stiffness of the barrel at a distance from the gap region 260 to further customize the strength of the gap region 260 or to further concentrate stresses in the gap region 260. In some embodiments, one or more of the fibrous bundles 510 may be positioned at a distance of approximately 1 to 2 inches from the reduced-durability region 530.

Figure 6:
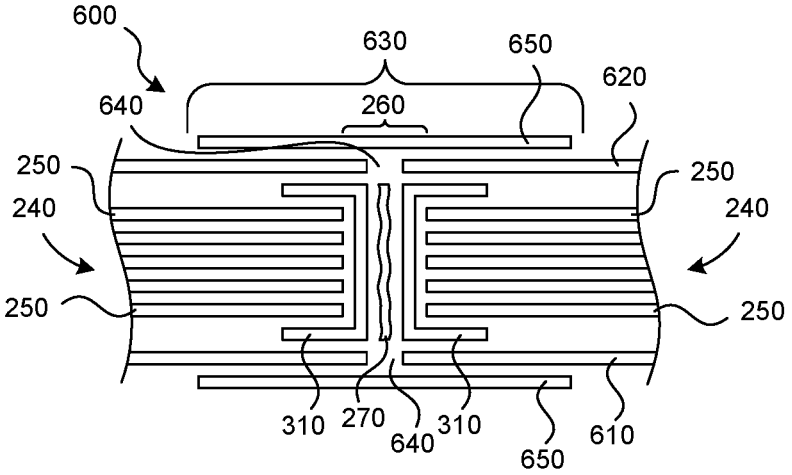
FIG. 6 illustrates a partial cross-sectional view of a portion of a barrel wall having a reduced-durability region according to another embodiment of the present technology.

FIG. 6 illustrates a partial cross-sectional view of a portion of a composite barrel wall 600 in the straight section 160 of the bat 100 having a reduced-durability region 630 according to another embodiment of the present technology. The wall 600 illustrated in FIG. 6 may be generally similar to the wall 300 illustrated and described above with regard to FIG. 3, but the gap region 260 extends through at least one of the inwardly facing skin 610 and the outwardly facing skin 620. For example, one or both of the inwardly facing skin 610 or the outwardly facing skin 620 may have a gap or discontinuity 640 that extends the gap region 260 through one or both of the inwardly facing skin 610 or the outwardly facing skin 620. The discontinuity 640 in the inwardly facing skin 610 or the outwardly facing skin 620 may be aligned with the gap region 260. A cover layer 650 may be positioned to cover the gap region 260 and the discontinuity 640.

Although two cover layers 650 are illustrated, in some embodiments with only one discontinuity 640, only one cover layer 650 may be used. The cover layers 650 may be formed with intermediate modulus carbon fiber composite (which may have a Young's Modulus or elastic modulus between approximately 42 million pounds per square inch and 55 million pounds per square inch) or another composite or non-composite material suitable for allowing through-failure of the bat wall 600 before significant delamination occurs in the stacks 240 of plies 250. Intermediate modulus carbon fiber materials may be beneficial because they generally provide more stiffness per unit weight than standard carbon fiber materials (which may have elastic modulus values around 33 million pounds per square inch). Intermediate modulus materials provide more stiffness than standard fiber materials while generally being less costly and less brittle than higher modulus fiber materials (which have elastic modulus values greater than 55 million pounds per square inch). The embodiment of the wall 600 and the reduced-durability region 630 illustrated and described with regard to FIG. 6 allows for further customization of the strength of the reduced-durability region 630 and the gap region 260.

Figure 7:
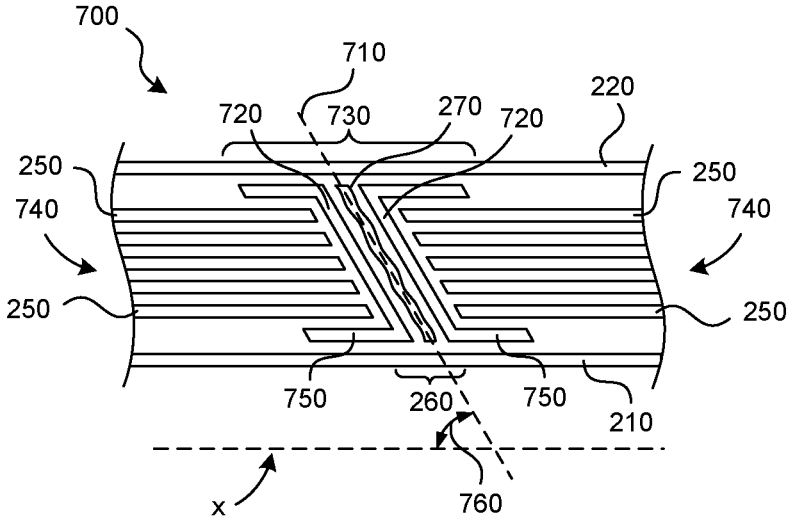
FIG. 7 illustrates a partial cross-sectional view of a portion of a barrel wall having a reduced-durability region according to another embodiment of the present technology.

FIG. 7 illustrates a partial cross-sectional view of a portion of a composite barrel wall 700 in the straight section 160 of the bat 100 having a reduced-durability region 730 in accordance with another embodiment of the present technology. The wall 700 illustrated in FIG. 7 may be generally similar to the wall 300 illustrated and described above with regard to FIG. 3, but the gap region 260 is oriented at an oblique angle. For example, an axis 710 of the gap region 260 (parallel to the transverse portions 720 of the cap ply elements 750 abutting the stacks 740) may be oriented at an angle 760 relative to the longitudinal or X-axis (labeled "x") of the bat. The angle 760 may have a value of between 1 and 89 degrees, for example, it may be between 30 and 65 degrees, or 60 degrees in a particular embodiment. The stacks 740, having plies 250, may be staggered or angled to correspond to the angle 760 of the gap region 260. The separation ply 270 may also be angled to correspond to the angle 760 of the gap region 260. Likewise, the cap ply elements 750, which may be similar to the cap ply elements 310 described above, may have transverse portions 720 that are also oriented along the angle 760.

In some embodiments, when the angle 760 is relatively small, the wall 700 and the reduced-durability region 730 increase in strength. For example, the wall 700 and the reduced-durability region 730 may withstand more forces before experiencing a through-failure in the gap region 260.

Although FIGS. 2-7 illustrate space between various layers, in some embodiments, the layers and components of embodiments of the present technology may be in generally intimate contact (via any resin or adhesive employed in the various embodiments).

Embodiments of the present technology provide reduced-durability regions to deter or discourage alteration. For example, if a user attempts to roll or perform other ABI processes, stresses in the bat wall will be focused along the gap between composite stacks rather than between the plies in the stacks, which will cause the wall of the bat to fail (destroying the bat) before significant delamination occurs that would otherwise improve performance. In addition, the present technology may provide a visual or tactile indicator of a failure of the bat wall prior to delamination (if any) between plies. Accordingly, the present technology allows for improved testing, improved indication of bat failure, and it may deter players from attempting to alter a bat.

From the foregoing, it will be appreciated that specific embodiments of the disclosed technology have been described for purposes of illustration, but that various modifications may be made without deviating from the technology, and elements of certain embodiments may be interchanged with those of other embodiments, and that some embodiments may omit some elements. For example, in various embodiments of the present technology, more than one separation ply may be used, or separation plies may be omitted. One or more cap ply elements (such as cap ply elements 310) may be omitted.

Further, while advantages associated with certain embodiments of the disclosed technology have been described in the context of those embodiments, other embodiments may also exhibit such advantages, and not all embodiments need necessarily exhibit such advantages to fall within the scope of the technology. Accordingly, the disclosure and associated technology may encompass other embodiments not expressly shown or described herein, and the invention is not limited except as by the appended claims.

What is claimed is:

1. A ball bat comprising a handle and a barrel, the barrel being attached to or continuous with the handle along a longitudinal axis of the bat, wherein the barrel comprises:

two stacks of composite laminate plies, wherein the stacks are spaced apart from each other along the longitudinal axis of the bat to form a gap therebetween;

an outwardly facing skin positioned between a first ply of a first one of the stacks and an exterior surface of the barrel;

an inwardly facing skin positioned between a second ply of the first one of the stacks and an interior hollow region of the barrel, wherein the stacks are positioned between the outwardly facing skin and the inwardly facing skin; and a fibrous bundle positioned in the gap and at least partially encircling the longitudinal axis of the bat;

wherein the gap extends all of a distance between the outwardly facing skin and the inwardly facing skin.

2. The ball bat of claim 1, further comprising a separation ply positioned in the gap between the stacks and oriented along a direction that is transverse to the longitudinal axis of the bat.

3. The ball bat of claim 2, wherein the fibrous bundle is a first fibrous bundle and the barrel comprises a second fibrous bundle positioned in the gap, wherein the separation ply is positioned between the first fibrous bundle and the second fibrous bundle.

4. The ball bat of claim 1, further comprising at least one cap ply element positioned around an end of one of the stacks.

5. The ball bat of claim 4, wherein the fibrous bundle is positioned between the cap ply element and the end of the one of the stacks.

6. A ball bat comprising a handle and a barrel, the barrel being attached to or continuous with the handle along a longitudinal axis of the bat, wherein the barrel comprises:

a first stack of composite laminate plies extending along the longitudinal axis of the bat;

a second stack of composite laminate plies extending along the longitudinal axis of the bat; and a plurality of fibers sandwiched between two plies in the first stack;

wherein:

the fibers encircle the longitudinal axis of the bat, and wherein the fibers are not contained within a ply; and the first stack and the second stack are spaced apart from each other along the longitudinal axis of the bat to form a gap therebetween.

7. The ball bat of claim 6, further comprising a separation ply positioned in the gap between the stacks and oriented along a direction that is transverse to the longitudinal axis of the bat.

8. The ball bat of claim 6, further comprising a cap ply element positioned around an end of the first stack, wherein the cap ply element comprises:

first and second portions that extend generally along the longitudinal axis and that are concentric with plies in the first stack; and a third portion extending between the first and second portions along a direction that is transverse to the plies in the first stack.

9. The ball bat of claim 6, wherein an axis of the gap is oriented at an oblique angle relative to the longitudinal axis.

10. A ball bat comprising a handle and a barrel, the barrel being attached to or continuous with the handle along a longitudinal axis of the bat, wherein the barrel comprises:

two stacks of composite laminate plies, wherein the stacks are spaced apart from each other along the longitudinal axis of the bat to form a gap therebetween; and an inwardly facing skin positioned between a first ply of a first one of the stacks and an interior hollow region of the barrel; wherein the inwardly facing skin comprises a discontinuity such that the gap extends through the inwardly facing skin.

11. The ball bat of claim 10, further comprising a cap ply element positioned around an end of the first one of the stacks.

12. The ball bat of claim 11, wherein the cap ply element comprises:

first and second portions that extend generally along the longitudinal axis and that are concentric with plies in the first stack; and a third portion extending between the first and second portions along a direction that is transverse to the plies in the first stack.

13. The ball bat of claim 10, further comprising a separation ply positioned in the gap and oriented along a direction that is transverse to the longitudinal axis of the bat.

14. The ball bat of claim 10, further comprising an outwardly facing skin positioned between a second ply of the first one of the stacks and an exterior surface of the barrel.

15. The ball bat of claim 14, wherein the discontinuity is a first discontinuity, and wherein the outwardly facing skin comprises a second discontinuity such that the gap extends through the outwardly facing skin.

16. The ball bat of claim 15, wherein the ball bat further comprises a cover layer positioned over at least one of the first discontinuity or the second discontinuity.

17. The ball bat of claim 10, wherein an axis of the gap is oriented at an oblique angle relative to the longitudinal axis.

18. A ball bat comprising a handle and a barrel, the barrel being attached to or continuous with the handle along a longitudinal axis of the bat, wherein the barrel comprises:

two stacks of composite laminate plies, wherein the stacks are spaced apart from each other along the longitudinal axis of the bat to form a gap therebetween;

a separation ply positioned in the gap between the stacks and oriented along a direction that is transverse to the longitudinal axis of the bat; and a fibrous bundle positioned in the gap and at least partially encircling the longitudinal axis of the bat.

19. A ball bat comprising a handle and a barrel, the barrel being attached to or continuous with the handle along a longitudinal axis of the bat, wherein the barrel comprises:

two stacks of composite laminate plies, wherein the stacks are spaced apart from each other along the longitudinal axis of the bat to form a gap therebetween;

at least one cap ply element positioned around an end of one of the stacks; and a fibrous bundle positioned in the gap and at least partially encircling the longitudinal axis of the bat.

* * * * *